US006859740B2

(12) United States Patent
Stephenson et al.

(10) Patent No.: US 6,859,740 B2
(45) Date of Patent: Feb. 22, 2005

(54) METHOD AND SYSTEM FOR DETECTING CAVITATION IN A PUMP

(75) Inventors: Stanley V. Stephenson, Duncan, OK (US); David M. Stribling, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/317,388

(22) Filed: Dec. 12, 2002

(65) Prior Publication Data

US 2004/0117132 A1 Jun. 17, 2004

(51) Int. Cl.[7] ..... G01B 5/28; G01B 5/30
(52) U.S. Cl. ..... 702/35
(58) Field of Search ..... 702/33–35, 45, 702/50, 127, 138; 417/20, 22

(56) References Cited

U.S. PATENT DOCUMENTS 4,205,945 A * 6/1980 Davis ..... 417/53
4,915,593 A * 4/1990 Cygnor ..... 417/245
5,427,498 A * 6/1995 Lehe et al. ..... 415/58.2
5,995,910 A * 11/1999 Discenzo ..... 702/56
6,213,739 B1 * 4/2001 Phallen et al. ..... 417/478
6,326,758 B1 * 12/2001 Discenzo ..... 318/609
6,330,525 B1 * 12/2001 Hays et al. ..... 702/183
6,347,283 B1 2/2002 Soliman et al.
6,663,349 B1 * 12/2003 Discenzo et al. ..... 417/44.1
6,701,274 B1 * 3/2004 Eryurek et al. ..... 702/140
6,757,665 B1 * 6/2004 Unsworth et al. ..... 706/15
2003/0014965 A1 * 1/2003 Hashimoto et al. ..... 60/259
2003/0084726 A1 * 5/2003 Yamazaki et al. ..... 73/587
2003/0094199 A1 * 5/2003 Roediger ..... 137/334
2003/0200060 A1 * 10/2003 Eryurek et al. ..... 702/188

OTHER PUBLICATIONS

Paper entitled "Cavitation Bubble Behavoir Near Solid Boundaries" by H. Ishida et al., dated 2001.
Paper entitled "On Cavitation In Fluid Power" by Timo Koivula et al., dated 2000.
SPE 71571 entitled "Application of Wavelet Transform to Analysis of Pressure Transient Data" by M. Soliman et al., dated 1996.

* cited by examiner

*Primary Examiner*—John Barlow
*Assistant Examiner*—Demetrius Pretlow
(74) *Attorney, Agent, or Firm*—John W. Wustenberg; Warren B. Kice

(57) ABSTRACT

A system receives a signal from a sensor indicative of a condition of a pump, decomposes the signal into a wavelet, and analyzes the wavelet to detect a likelihood of cavitation in the pump.

25 Claims, 13 Drawing Sheets

METHOD AND SYSTEM FOR DETECTING CAVITATION IN A PUMP

BACKGROUND

The disclosures herein relate generally to pumps and in particular to a method and system for detecting cavitation in a pump. Often, there is a need for detecting cavitation in a pump, such as a positive displacement pump. However, previous techniques for detecting cavitation in a pump have various shortcomings. Thus, a need has arisen for a method and system for detecting cavitation in a pump, in which various shortcomings of previous techniques are overcome.

DETAILED DESCRIPTION

Figure 1:
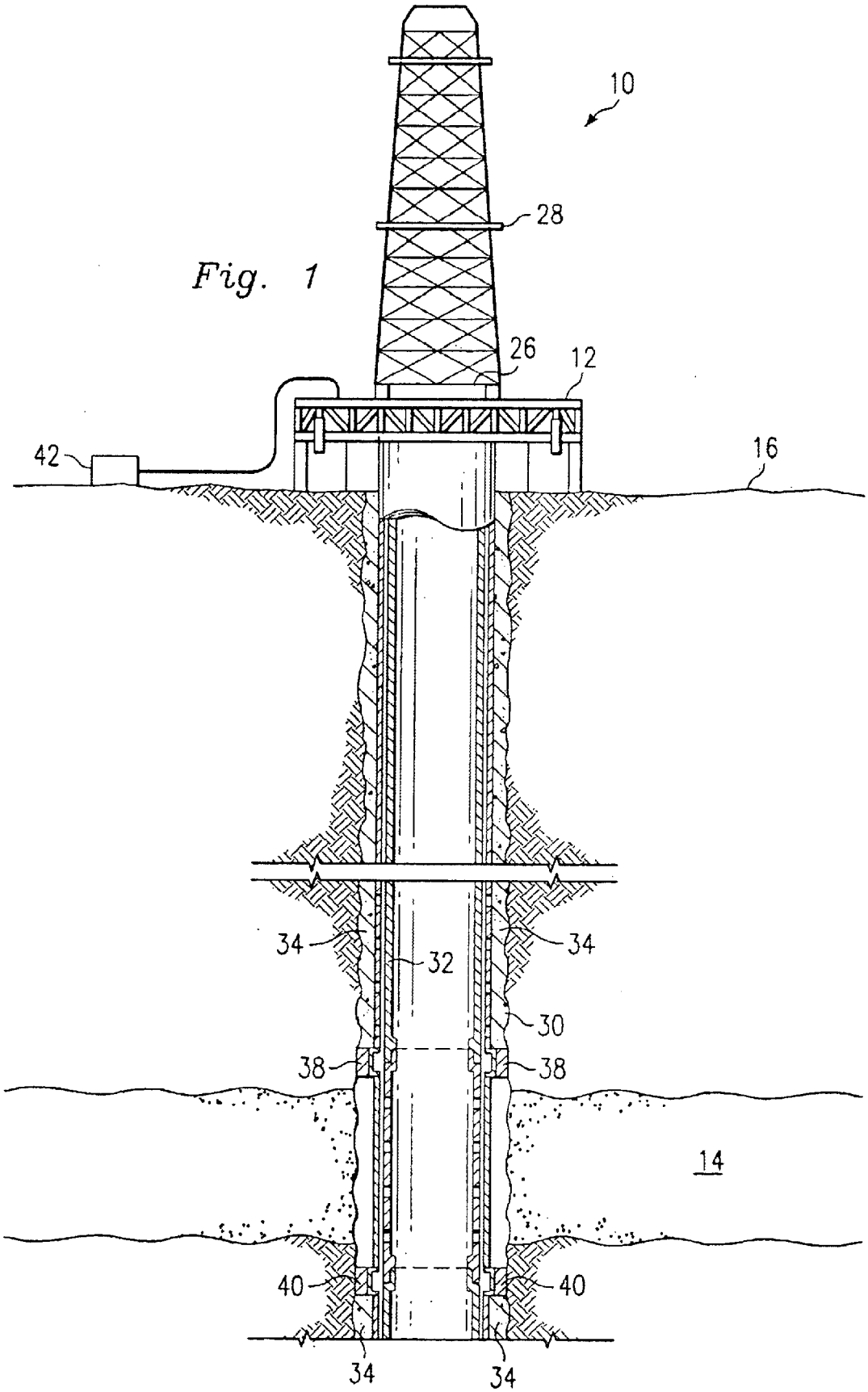
FIG. 1 is a partial elevational/partial sectional view of apparatus for transferring material in a wellbore.

FIG. 1 shows apparatus, indicated generally at 10, for transferring material from a surface-located oil and/or gas well site 12. The well site 12 is located over an oil and/or gas bearing formation 14, which is located below a ground surface 16. The well site 12 has a hoisting apparatus 26 and a derrick 28 for raising and lowering pipe strings such as a work string, or the like.

A wellbore 30 is formed through the various earth strata including the formation 14. As discussed further below, a pipe, or casing, 32 is insertable into the wellbore 30 and is cemented within the wellbore 30 by cement 34. A centralizer/packer device 38 is located in the annulus between the wellbore 30 and the casing 32 just above the formation 14, and a centralizer/packer device 40 is located in the annulus between the wellbore 30 and the casing 32 just below the formation 14.

A pump system 42 is located at the well site 12. The pump system 42 is operable for transferring material through the casing 32 between the well site 12 and the formation 14. The pump system 42 is described further hereinbelow in connection with FIGS. 2–17.

Figure 2:
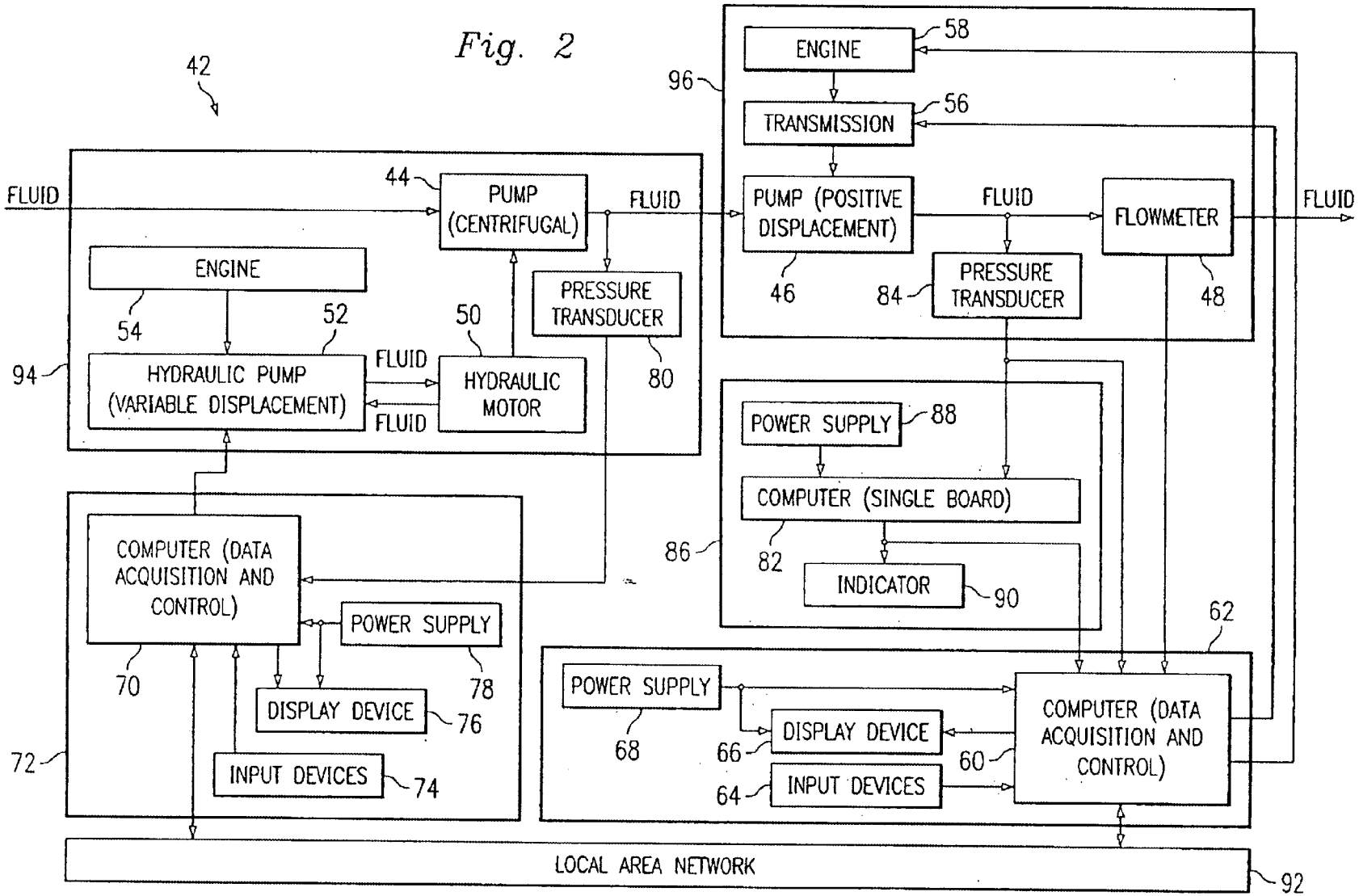
FIG. 2 is a block diagram of a pump system of the apparatus of FIG. 1, including a system for detecting cavitation in a pump.

FIG. 2 is a block diagram of the pump system 42, including a subsystem for detecting cavitation in a pump. As shown in FIG. 2, the pump system 42 transfers fluid material through a boost or centrifugal pump 44, a positive displacement pump 46, and a flowmeter 48. The centrifugal pump 44 has a maximum pressure per square inch ("psi") of ~100, and a typical operating psi of ~30–50. The positive displacement pump 46 has a maximum psi of ~20,000, and a typical operating psi of ~1,000–15,000.

The centrifugal pump 44 performs a pumping operation by receiving the fluid material from a source (not shown in FIG. 2) and outputting it to the positive displacement pump 46. The positive displacement pump 46 performs a pumping operation by receiving the fluid material from the centrifugal pump 44 and outputting it to the flowmeter 48. The flowmeter 48 performs a measuring operation by receiving the fluid material from the positive displacement pump 46, measuring its rate of flow, and outputting it to a destination (not shown in FIG. 2).

The centrifugal pump 44 is powered by a hydraulic motor 50. Accordingly, a speed (i.e. flow rate or pumping rate) of the centrifugal pump 44 is governed by a speed of the hydraulic motor 50. As the speed of the hydraulic motor 50 increases, the speed of the centrifugal pump 44 increases. As the speed of the hydraulic motor 50 decreases, the speed of the centrifugal pump 44 decreases.

The speed of the hydraulic motor 50 is governed by a rate of fluid material circulated between the hydraulic motor 50 and a variable displacement hydraulic pump 52. The hydraulic pump 52 is powered by an engine 54 (e.g. a diesel-powered internal combustion engine). In normal operation, the engine 54 operates at a substantially constant speed.

The hydraulic pump 52 has a variable displacement. Accordingly, by varying such displacement, the rate of such fluid material (circulated between the hydraulic pump 52 and the hydraulic motor 50) is adjusted. As the rate of such fluid material increases (i.e. such displacement increases), the speed of the hydraulic motor 50 increases. As the rate of such fluid material decreases (i.e. such displacement decreases), the speed of the hydraulic motor 50 decreases.

The positive displacement pump 46 is powered by a transmission 56. The transmission 56 is powered by an engine 58 (e.g. a diesel-powered internal combustion engine). Accordingly, the transmission 56 operates in a conventional manner to apply power from the engine 58 to the positive displacement pump 46. The transmission 56 in this example has seven gears, which are independently selectable (e.g. by shifting between the seven gears in a conventional manner).

The engine 58 has a variable speed. A speed (i.e. flow rate or pumping rate) of the positive displacement pump 46 is governed by a speed of the engine 58. As the speed of the engine 58 increases, the speed of the positive displacement pump 46 increases. As the speed of the engine 58 decreases, the speed of the positive displacement pump 46 decreases.

A gear of the transmission 56 is selected by a data acquisition and control ("DAC") computer 60, which (a) is connected to various solenoids (not shown in FIG. 2) of the transmission 56 and (b) suitably applies electrical power to one or more of the solenoids for shifting between the seven gears of the transmission 56. Speed of the engine 58 is adjusted by the DAC computer 60 in response to a variable analog current signal (4–20 mA), which is output by the DAC computer 60 to the engine 58.

As shown in FIG. 2, the DAC computer 60 is part of a computing system, indicated by a solid enclosure 62. The computing system 62 includes (a) the DAC computer 60 for executing and otherwise processing instructions, (b) input devices 64 for receiving information from a human user (not shown in FIG. 2), (c) a display device 66 (e.g. a conventional liquid crystal display device) for displaying information to a human user, and (d) a power supply 68 for supplying electrical power to the DAC computer 60 and to the display device 66. The DAC computer 60 is discussed further hereinbelow.

Displacement of the hydraulic pump 52 is adjusted by a DAC computer 70 in response to a variable analog current signal (4–20 mA), which is output by the DAC computer 70 to the hydraulic pump 52. As the DAC computer 70 increases the variable analog current signal, displacement of the hydraulic pump 52 increases. As the DAC computer 70 decreases the variable analog current signal, displacement of the hydraulic pump 52 decreases.

As shown in FIG. 2, the DAC computer 70 is part of a computing system, indicated by a solid enclosure 72. The computing system 72 includes (a) the DAC computer 70 for executing and otherwise processing instructions, (b) input devices 74 for receiving information from a human user (not shown in FIG. 2), (c) a display device 76 for displaying information to a human user, and (d) a power supply 78 for supplying electrical power to the DAC computer 70 and to the display device 76. The DAC computer 70 is discussed further hereinbelow.

In adjusting displacement of the hydraulic pump 52, the DAC computer 70 receives a variable analog current signal (4–20 mA) from a pressure transducer 80 at a rate of 10 Hz. The pressure transducer 80 is connected to the fluid material output from the centrifugal pump 44, which is the same fluid material output that is connected to the positive displacement pump 46. The analog current signal from the pressure transducer 80 is indicative of a pressure of the fluid material output from the centrifugal pump 44.

For example, as the speed of the centrifugal pump 44 increases, the rate and pressure of such fluid material output increases (so long as a sufficient amount of fluid material is available for receipt by the centrifugal pump 44), and the variable analog current signal (output from the pressure transducer 80 to the DAC computer 70) increases. As the speed of the centrifugal pump 44 decreases, the rate and pressure of such fluid material output decreases, and the variable analog current signal decreases. Accordingly, in response to the variable analog current signal from the pressure transducer 80, the DAC computer 70 calculates the pressure of fluid material output from the centrifugal pump 44, and the DAC computer 70 recursively adjusts displacement of the hydraulic pump 52 to achieve a specified pressure of fluid material output from the centrifugal pump 44.

A single board computer 82 receives a variable analog current signal (4–20 mA) from a pressure transducer 84 at a rate of 100–1,000 Hz. The pressure transducer 84 is connected to the fluid material output from the positive displacement pump 46, which is the same fluid material output that is connected to the flowmeter 48. The analog current signal from the pressure transducer 84 is indicative of a pressure of the fluid material output from the positive displacement pump 46.

For example, as the pressure of such fluid material output increases, the variable analog current signal (output from the pressure transducer 84 to the single board computer 82) increases. As the pressure of such fluid material output decreases, the variable analog current signal decreases.

The single board computer 82 is part of a computing system, indicated by a solid enclosure 86. The computing system 86 includes (a) the single board computer 82 for executing and otherwise processing instructions, (b) a power supply 88 for supplying electrical power to the single board computer 82, and (c) an indicator 90 (e.g. a light emitting diode ("LED")) for indicating a cavitation event in response to a signal from the single board computer 82. The single board computer 86 and the cavitation event are discussed further hereinbelow.

As shown in FIG. 2, the DAC 60 and the DAC 70 communicate with one another through a local area network ("LAN") 92, such as an Ethernet network. Also, as shown in FIG. 2, the DAC computer 60 receives the signal (indicating a cavitation event) from the single board computer 82, in the same manner as the indicator 90 receives it, and the DAC computer 60 digitally records the cavitation event by writing information to a computer-readable medium of the DAC computer 60 (for storage by the computer-readable medium). Such recordation is useful for statistical analysis and life calculations.

Further, as shown in FIG. 2, the DAC computer 60 receives the variable analog current signal from the pressure transducer 84 at a rate of 10 Hz, but otherwise in the same manner as the single board computer 82 receives it. Moreover, as shown in FIG. 2, the DAC computer 60 receives a frequency signal from the flowmeter 48 at a rate of 10 Hz. As the flowmeter 48 measures a higher rate of flow (of the fluid material received from the positive displacement pump 46), the frequency signal increases. As the flowmeter 48 measures a lower rate of flow, the frequency signal decreases.

Accordingly, in response to the frequency signal from the flowmeter 48, the DAC computer 60 calculates the rate of flow, and the DAC computer 60 digitally records its calculation by writing information to the computer-readable medium of the DAC computer 60 (for storage by the computer-readable medium) at a rate of 10 Hz. Likewise, in response to the analog current signal from the pressure transducer 84, the DAC computer 60 calculates the pressure (of the fluid material output from the positive displacement pump 46), and the DAC computer 60 digitally records its calculation by writing information to the computer-readable medium of the DAC computer 60 (for storage by the computer-readable medium) at a rate of 10 Hz. Such recordations are useful for statistical analysis and life calculations.

The centrifugal pump 44, the hydraulic motor 50, the hydraulic pump 52, the engine 54, and the pressure transducer 80 are part of a centrifugal pump subsystem, indicated by a solid enclosure 94. The positive displacement pump 46, the flowmeter 48, the transmission 56, the engine 58, and the pressure transducer 84 are part of a positive displacement pump subsystem, indicated by a solid enclosure 96. The centrifugal pump subsystem 94 operates as a boost section of a blender that blends a viscous gel by mixing a proppant (e.g. sand) with fluid material. By operating as a boost section, the centrifugal pump subsystem 94 boosts pressure to the positive displacement pump subsystem 96, so that the positive displacement pump subsystem 96 more efficiently pumps such blended fluid material into the wellbore 30, the casing 32 and the annulus.

Figure 3:
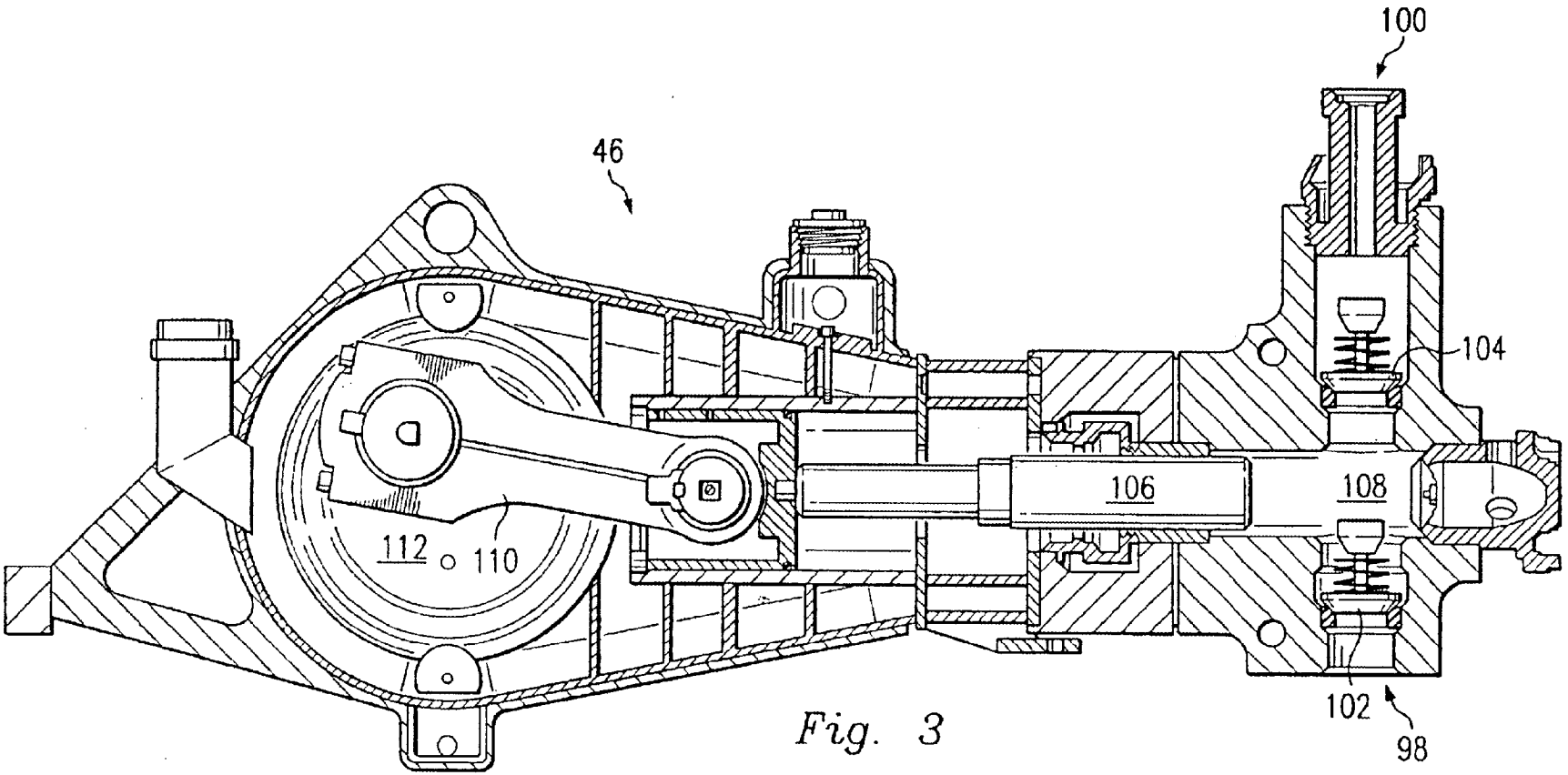
FIG. 3 is a cross-sectional view of a portion of a positive displacement pump of the pump system of FIG. 2.

FIG. 3 is a cross-sectional view of a portion of the positive displacement pump 46, which operates in a conventional manner. Accordingly, the positive displacement pump 46 includes (a) an input 98, which receives fluid material from the centrifugal pump 44, and (b) an output 100, which outputs fluid material to the flowmeter 48. The pressure transducer 84 (FIG. 2) is located directly on top of the output 100, so that the single board computer 82 monitors pressure of the fluid material output from the positive displacement pump 46.

As shown in FIG. 3, the positive displacement pump 46 includes (a) a suction valve 102 for controlling the receipt of fluid material through the input 98 and (b) a discharge valve 104 for controlling the output of fluid material through the output 100. Also, the positive displacement pump 46 includes a plunger 106 for controlling a pressure in a chamber 108 of the positive displacement pump 46, so that fluid material is suitably (a) received through the input 98, around the suction valve 102, and into the chamber 108 and (b) output from the chamber 108, around the discharge valve 104, and through the output 100.

Moreover, as shown in FIG. 3, the plunger 106 is coupled through a crosshead to a connecting rod 110. The connecting rod 110 is connected to a crankshaft 112. The engine 58 is coupled to the crankshaft 112 through the transmission 56 and a drive shaft (not shown in FIG. 3). Through the transmission 56, the engine 58 rotates the drive shaft and, in turn, rotates the crankshaft 112 in a counterclockwise direction (as viewed from the perspective of FIG. 3). At a rate of once per 360° counterclockwise rotation of the crankshaft 112, the connecting rod 110 moves the plunger 106 into and out of the chamber 108.

In a first embodiment, the positive displacement pump 46 includes three substantially identical portions, and the portion of FIG. 3 is a representative one of those portions. The crankshafts of those portions are connected to one another, yet aligned at 120° intervals relative to one another. Accordingly, each portion operates 120° and 240° out-of-phase with the other two portions, respectively, so that such portions collectively generate a more uniform rate of flow from the centrifugal pump 44 to the flowmeter 48.

In a second embodiment, the positive displacement pump 46 includes five substantially identical portions, and the portion of FIG. 3 is a representative one of those portions. The crankshafts of those portions are connected to one another, yet aligned at 72° intervals relative to one another. Accordingly, each portion operates 72°, 144°, 216° and 288° out-of-phase with the other four portions, respectively, so that such portions collectively generate a more uniform rate of flow from the centrifugal pump 44 to the flowmeter 48.

FIGS. 4*a–e* are kinematical diagrams of five stages, respectively, of operation of the positive displacement pump 46 in a situation without cavitation. The crankshaft 112 rotates in a counterclockwise direction, as indicated by an arrow 114. The positive displacement pump 46 pumps fluid material in a direction indicated by an arrow 116.

Figure 4B:
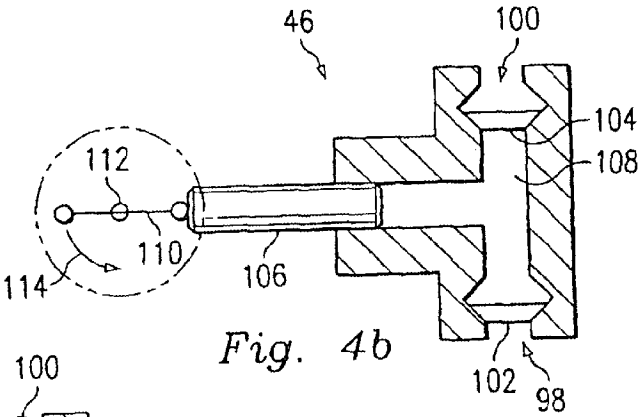
FIGS. 4*a–e* are kinematical diagrams of five stages, respectively, of operation of the positive displacement pump of FIG. 3 in a situation without cavitation.
Figure 4E:
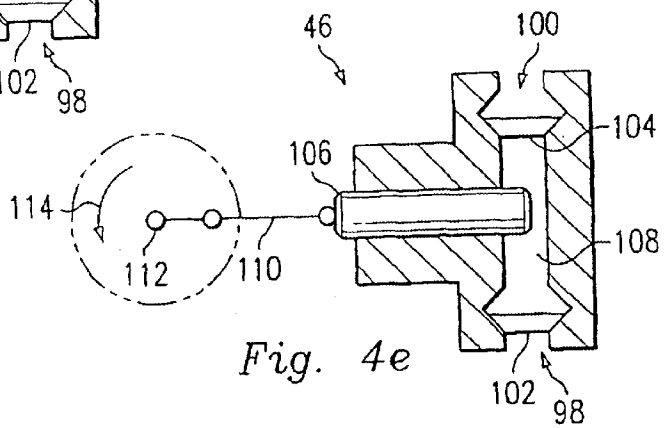
Figure 4C:
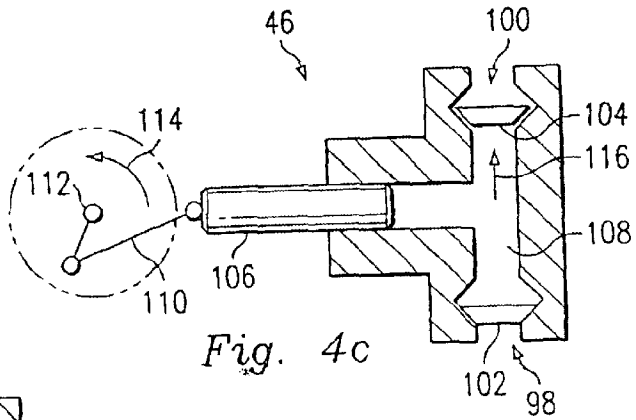
Figure 4A:
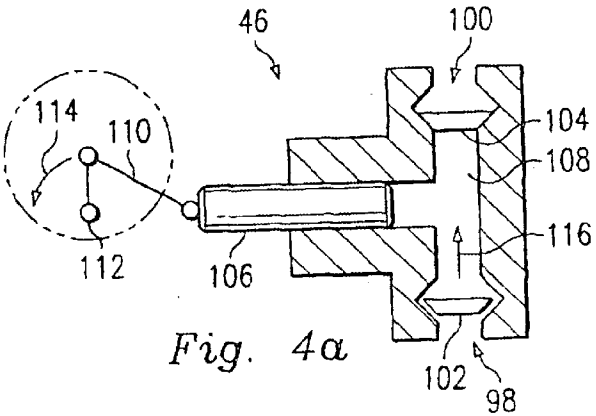

FIG. 4*a* shows a suction stroke, in which (a) the suction valve 102 is open, (b) the discharge valve 104 is closed, and (c) the plunger 106 moves out of the chamber 108 to draw fluid material from the centrifugal pump 44 through the input 98, around the suction valve 102, and into the chamber 108.

FIG. 4*b* shows an end of the suction stroke, in which (a) the suction valve 102 is closed, (b) the discharge valve 104 is closed, and (c) the plunger 106 ends moving out of the chamber 108 and begins moving into the chamber 108.

Figure 4D:
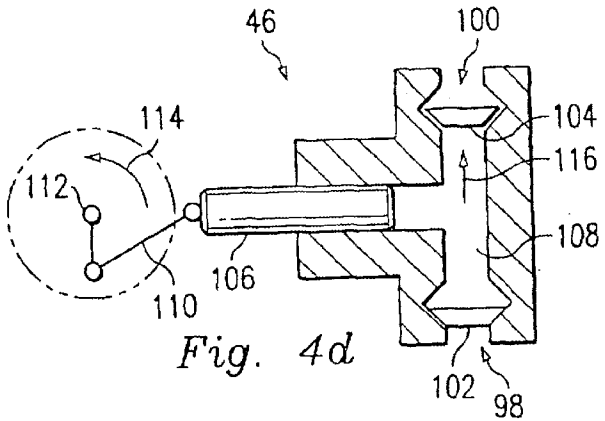

FIGS. 4*c* and 4*d* show a discharge stroke, in which (a) the suction valve 102 is closed, (b) the discharge valve 104 is open, and (c) the plunger 106 moves into the chamber 108 to push fluid material out of the chamber 108, around the discharge valve 104, and through the output 100 to the flowmeter 48.

FIG. 4*e* shows an end of the discharge stroke, in which (a) the suction valve 102 is closed, (b) the discharge valve 104 is closed, and (c) the plunger 106 ends moving into the chamber 108 and begins moving out of the chamber 108.

FIGS. 5*a–e* are kinematical diagrams of five stages, respectively, of operation of the positive displacement pump 46 in a situation with cavitation. The crankshaft 112 rotates in a counterclockwise direction, as indicated by the arrow 114. The positive displacement pump 46 pumps fluid material in a direction indicated by the arrow 116.

Figure 5B:
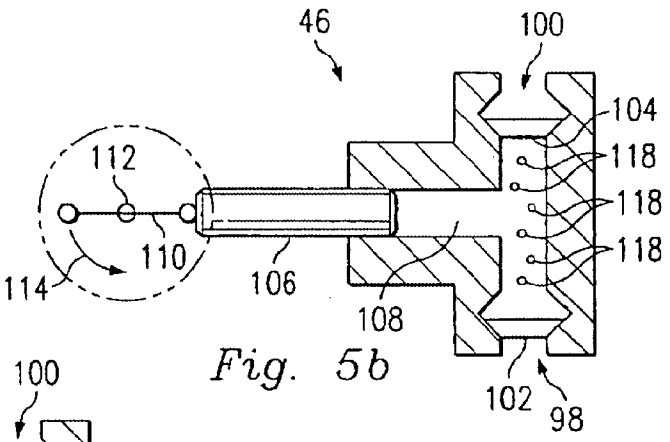
FIGS. 5*a–e* are kinematical diagrams of five stages, respectively, of operation of the positive displacement pump of FIG. 3 in a situation with cavitation.
Figure 5C:
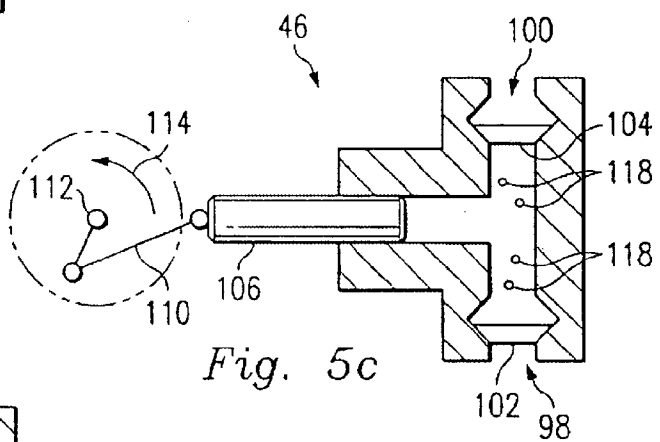
Figure 5E:
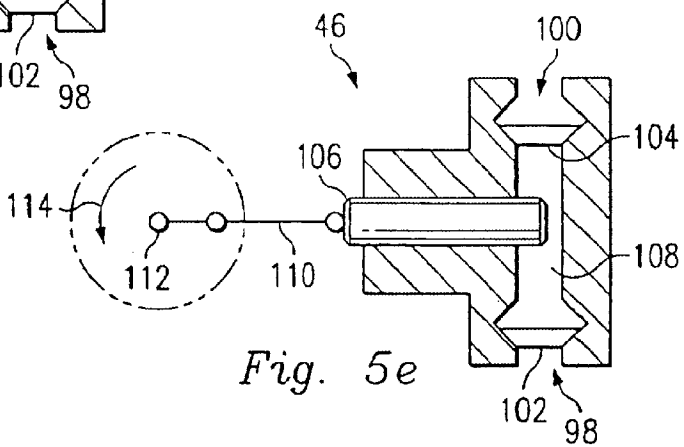
Figure 5A:
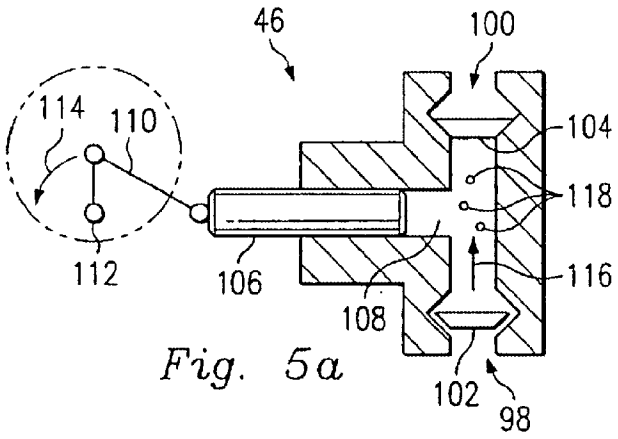

FIG. 5*a* shows a suction stroke, in which (a) the suction valve 102 is open, (b) the discharge valve 104 is closed, and (c) the plunger 106 moves out of the chamber 108 to draw fluid material from the centrifugal pump 44 through the input 98, around the suction valve 102, and into the chamber 108. Nevertheless, if an insufficient amount of fluid material is received from the centrifugal pump 44 (e.g. pressure of fluid material output from the centrifugal pump 44 is too low in relation to a net positive suction head ("NPSH") requirement, which is a function of the fluid material type or air entrainment), then cavitation bubbles 118 form within the chamber 108 during the suction stroke, because an internal pressure of the chamber 108 falls below a vapor pressure of the fluid material.

FIG. 5*b* shows an end of the suction stroke, in which (a) the suction valve 102 is closed, (b) the discharge valve 104 is closed, and (c) the plunger 106 ends moving out of the chamber 108 and begins moving into the chamber 108. The cavitation bubbles 118 (formed during the suction stroke) remain within the chamber 108.

FIG. 5*c* shows a first part of a discharge stroke, in which (a) the suction valve 102 is closed, (b) the discharge valve 104 is closed, and (c) the plunger 106 moves into the chamber 108. Unlike the discharge stroke of FIG. 4*c*, the discharge valve 104 is closed instead of open, due to collapse of the cavitation bubbles 118, which delays an increase of pressure that would otherwise open the discharge valve 104. Accordingly, during the first part of the discharge stroke, the plunger 106 substantially fails to push fluid material out of the chamber 108, around the discharge valve 104, and through the output 100 to the flowmeter 48.

Figure 5D:
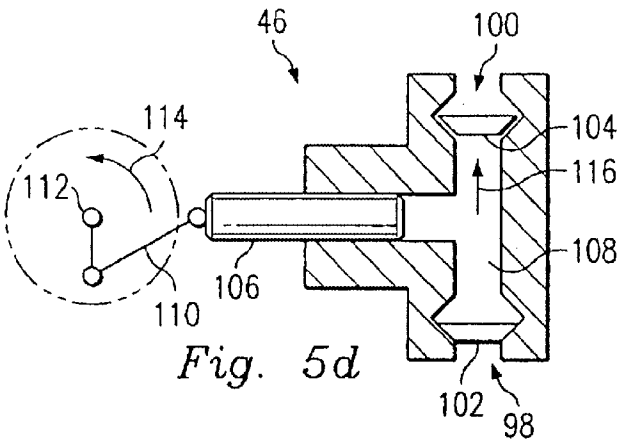

FIG. 5*d* shows a second part of the discharge stroke, in which (a) the suction valve 102 is closed, (b) the discharge valve 104 is open, and (c) the plunger 106 moves further into the chamber 108 to push fluid material out of the chamber 108, around the discharge valve 104, and through the output 100 to the flowmeter 48.

FIG. 5*e* shows an end of the discharge stroke, in which (a) the suction valve 102 is closed, (b) the discharge valve 104 is closed, and (c) the plunger 106 ends moving into the chamber 108 and begins moving out of the chamber 108.

After the cavitation bubbles 118 finish collapsing (between the first part of the discharge stroke in FIG. 5*c* and the second part of the discharge stroke in FIG. 5*d*), the plunger 106 experiences a sudden increase in pressure and impact load, which can damage various driveline mechanical components, such as the connecting rod 110, the crankshaft 112, the drive shaft (not shown in FIGS. 5*a*–*e*), the transmission 56, and the engine 58. Moreover, due to high velocity jetting of fluid material and pinpoint high temperatures (up to ~5000° C.) resulting from speed of the cavitation bubbles 118 collapsing, damage (e.g. erosion) can occur to the plunger 106 and other components exposed to the chamber 108. Accordingly, it is preferable to avoid such cavitation (i.e. formation of the cavitation bubbles 118) in the positive displacement pump 46.

The pump system 42 substantially avoids such cavitation by (a) monitoring various conditions in the positive displacement pump 46 to predictively detect a likelihood of such cavitation and (b) automatically adjusting an operation of pump system 42 to predictively reduce the likelihood of such cavitation, preferably before such cavitation extensively develops (and preferably before experiencing a material adverse effect of such cavitation). In the pump system 42, the single board computer 82 helps to substantially achieve such a result by (a) at a relatively low rate of 100–1,000 Hz, receiving the variable analog current signal (4–20 mA) from the pressure transducer 84, (b) identifying noise components of the signal, such as by decomposing (or "transforming") the signal into wavelets, and (c) analyzing those noise components to predictively detect a likelihood of such cavitation in the positive displacement pump 46. In response to such detection, the pump system 42 adjusts its operation to predictively reduce the likelihood of such cavitation.

For example, one type of wavelet is a Daubechies 10 ("Db 10") wavelet, as described in U.S. Pat. No. 6,347,283, which is hereby incorporated in its entirety herein by this reference. By decomposing the analog current signal (from the pressure transducer 84) into a Db10 wavelet and analyzing a $7^{th}$ order (or $7^{th}$ level) wavelet decomposition thereof, the single board computer 82 predictively detects a likelihood of such cavitation in the positive displacement pump 46. Although the single board computer 82 uses $7^{th}$ order wavelet decompositions of Db10 wavelets in this manner, it may alternatively use any $n^{th}$ order wavelet decomposition of any Daubechies wavelet (e.g. any of Daubechies 2 through Daubechies 10 wavelets) or any other compactly supported ortho normal wavelets, according to particular aspects of various embodiments.

In an alternative embodiment, the single board computer 82 receives a frequency signal from the flowmeter 48 (instead of, or in addition to, the analog current signal from the pressure transducer 84). In such an alternative embodiment, the single board computer 82 (a) calculates a volumetric efficiency of the positive displacement pump 46 in response to the flowrate and the pump speed and (b) detects a likelihood of cavitation in the positive displacement pump 46 in response to a decrease in the volumetric efficiency.

In another alternative embodiment, the pressure transducer 84 (FIG. 2) is located directly below the input 98 (FIG. 3) of the positive displacement pump 46 (instead of directly on top of the output 100), so that the single board computer 82 monitors pressure of the fluid material received by the positive displacement pump 46 (which is the fluid material output from the centrifugal pump 44, instead of the fluid material output from the positive displacement pump 46). In such an alternative embodiment, by decomposing the analog current signal (from the pressure transducer 84) into a Db10 wavelet and analyzing a $7^{th}$ order wavelet decomposition thereof, the single board computer 82 predictively detects a likelihood of such cavitation in the positive displacement pump 46.

Figure 6:
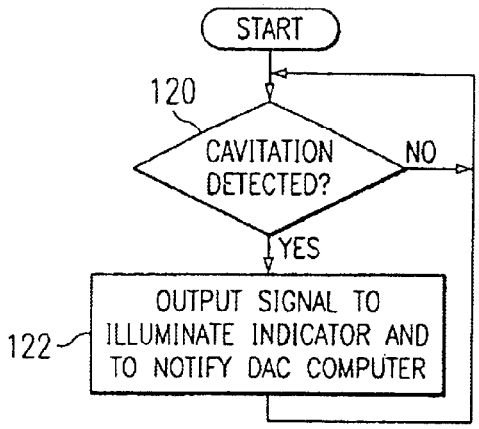
FIG. 6 is a flowchart of operation of a single board computer of the pump system of FIG. 2.

FIG. 6 is a flowchart of operation of the single board computer 82. The operation starts at a step 120, at which the single board computer 82 decomposes the analog current signal (from the pressure transducer 84) into a Db10 wavelet and analyzes a $7^{th}$ order wavelet decomposition thereof to predictively detect a likelihood of cavitation in the positive displacement pump 46. If the single board computer 82 does not detect such likelihood at the step 120, the operation self-loops at the step 120. Conversely, if the single board computer 82 detects such likelihood at the step 120, the operation continues to a step 122, at which the single board computer 82 outputs a signal to illuminate the indicator 90 and to notify the DAC computer 60 about the cavitation event (i.e. about such likelihood of cavitation in the positive displacement pump 46). After the step 122, the operation returns to the step 120.

Figure 7:
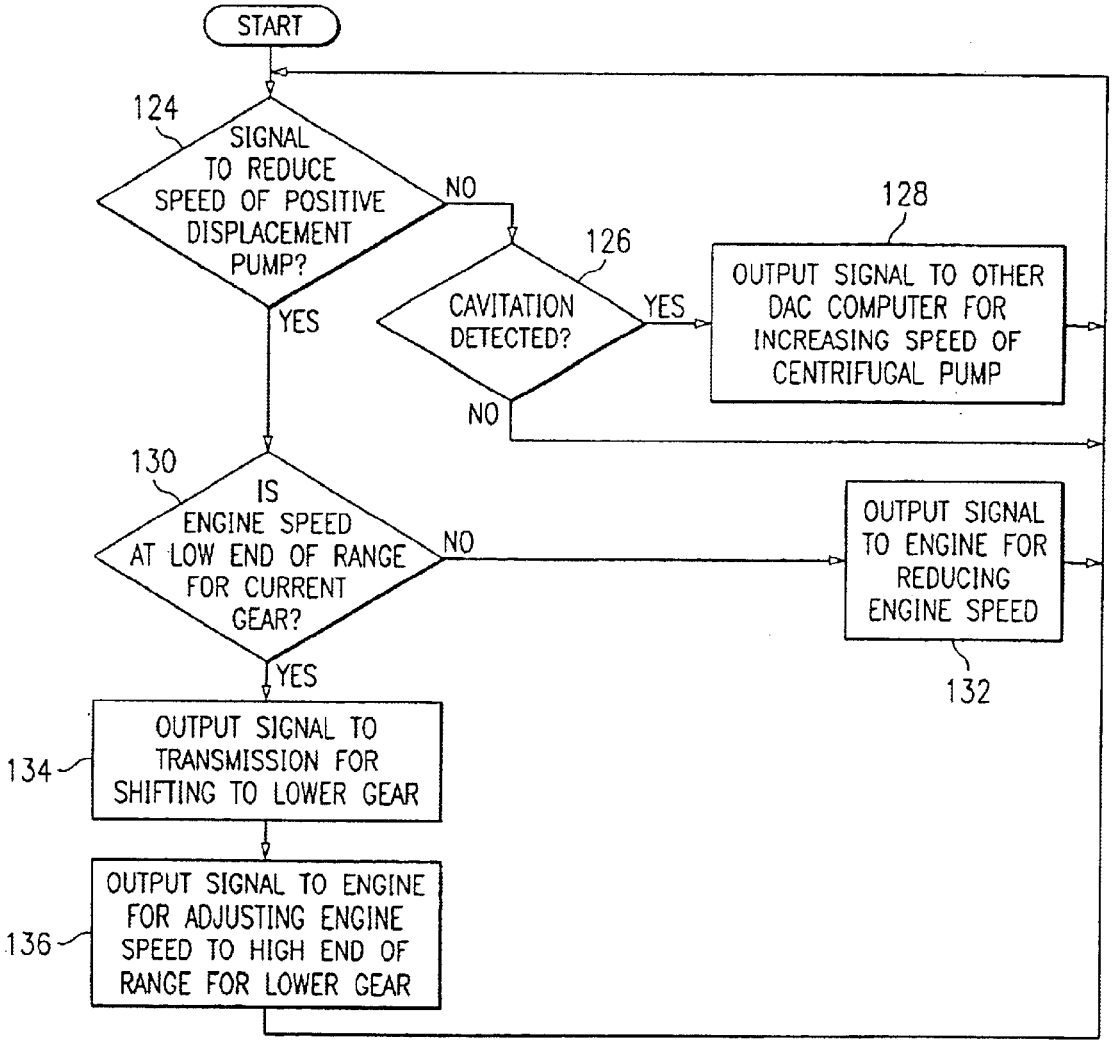
FIG. 7 is a flowchart of operation of a data acquisition and control computer of a positive displacement pump subsystem of FIG. 2.

FIG. 7 is a flowchart of operation of the DAC computer 60. The operation starts at a step 124, at which the DAC computer 60 determines whether it has received (from the DAC computer 70 through the LAN 92) a signal to reduce speed of the positive displacement pump 46. If not, the operation continues to a step 126, at which the DAC computer 60 determines whether it has received (from the single board computer 82) a signal that indicates a cavitation event. If not, the operation returns to the step 124.

Conversely, at the step 126, if the DAC computer 60 determines that it has received (from the single board computer 82) a signal that indicates a cavitation event, the operation continues to a step 128. At the step 128, the DAC computer 60 outputs a signal (through the LAN 92 to the DAC computer 70) to increase speed of the centrifugal pump 44. After the step 128, the operation returns to the step 124.

Referring again to the step 124, if the DAC computer 60 determines that it has received (from the DAC computer 70 through the LAN 92) a signal to reduce speed of the positive displacement pump 46, the operation continues to a step 130. At the step 130, the DAC computer 60 determines whether speed of the engine 58 is at a low end of its range for the current gear of the transmission 56. If not, the operation continues to a step 132, at which the DAC computer 60 adjusts the variable analog current signal (4–20 mA) to the engine 58, in order to reduce speed of the engine 58 and accordingly reduce speed of the positive displacement pump 46. After the step 132, the operation returns to the step 124.

Referring again to the step 130, if the DAC computer 60 determines that speed of the engine 58 is at a low end of its range for the current gear of the transmission 56, the operation continues to a step 134. At the step 134, the DAC computer 60 suitably applies electrical power to one or more solenoids of the transmission 56 for shifting to a next lower gear of the transmission 56. After the step 134, the operation continues to a step 136, at which the DAC computer 60 adjusts the variable analog current signal (4–20 mA) to the engine 58, in order to adjust speed of the engine 58 to a high end of its range for the new current gear of the transmission 56. After the step 136, the operation returns to the step 124.

Figure 8:
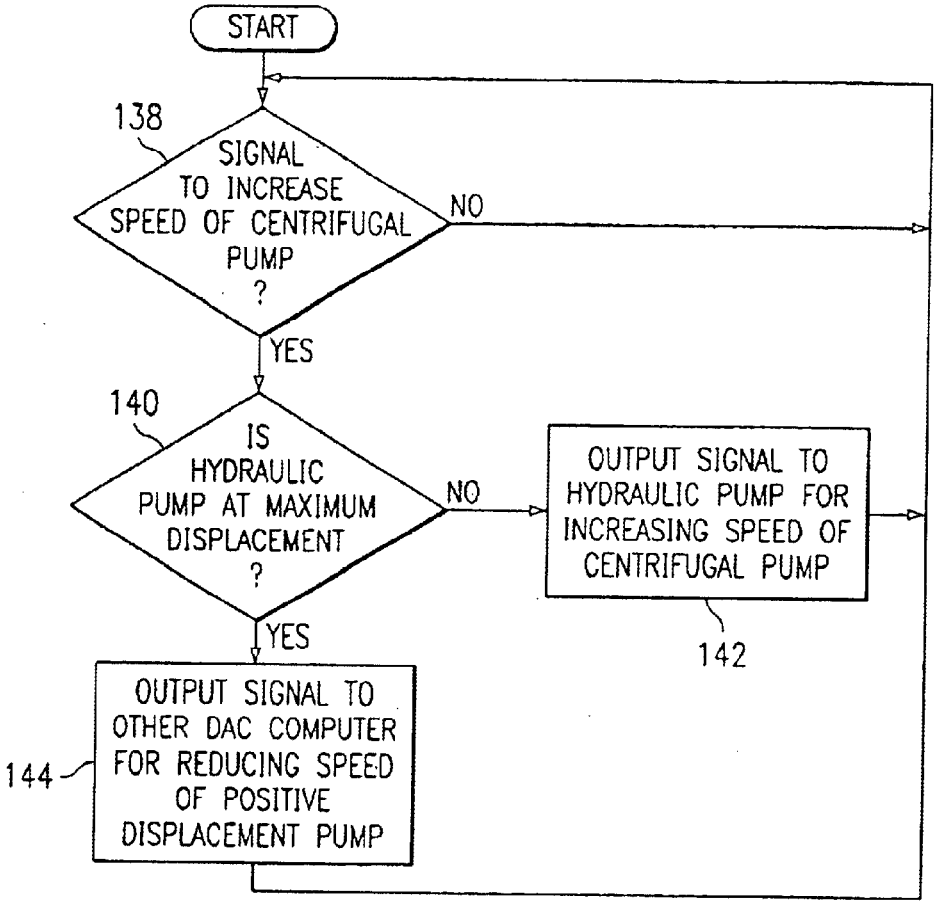
FIG. 8 is a flowchart of operation of a data acquisition and control computer of a centrifugal pump subsystem of FIG. 2.

FIG. 8 is a flowchart of operation of the DAC computer 70. The operation starts at a step 138, at which the DAC computer 70 determines whether it has received (from the DAC computer 60 through the LAN 92) a signal to increase speed of the centrifugal pump 44. If not, the operation self-loops at the step 138.

Conversely, at the step 138, if the DAC computer 70 determines that it has received (from the DAC computer 60 through the LAN 92) a signal to increase speed of the centrifugal pump 44, the operation continues to a step 140. At the step 140, the DAC computer 70 determines whether the hydraulic pump 52 is operating at its maximum displacement. If not, the operation continues to a step 142, at which the DAC computer 70 increases the variable analog current signal to the hydraulic pump 52, in order to increase displacement of the hydraulic pump 52 and accordingly increase speed of the centrifugal pump 44. After the step 142, the operation returns to the step 138.

Referring again to the step 140, if the DAC computer 70 determines that the hydraulic pump 52 is operating at its maximum displacement, the operation continues to a step 144. At the step 144, the DAC computer 70 outputs (through the LAN 92 to the DAC computer 60) a signal to reduce speed of the positive displacement pump 46. After the step 144, the operation returns to the step 138.

Although cavitation might be substantially avoided by continually operating the centrifugal pump 44 at maximum speed to output fluid material at maximum pressure to the positive displacement 46, such operation would likely damage the centrifugal pump 44. Accordingly, some previous techniques have allowed cavitation to extensively develop, yet attempted to detect cavitation after such development.

Figure 9A:
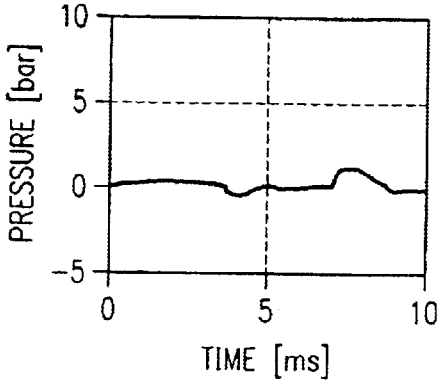
FIGS. 9*a–b* are graphs of downstream chamber pressure and test block acceleration, respectively, of a test block in a situation without cavitation.
Figure 9B:
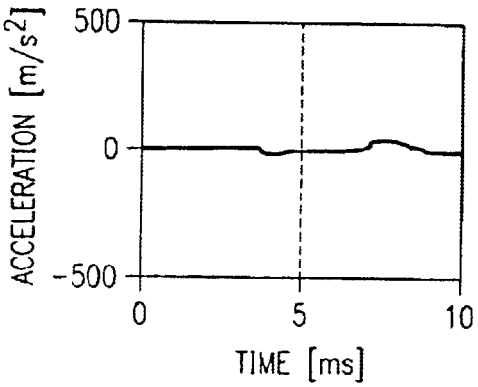
Figure 10A:
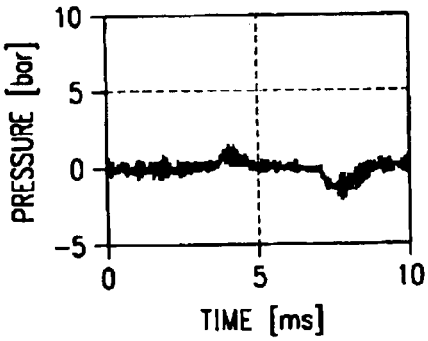
FIGS. 10*a–b* are graphs of downstream chamber pressure and test block acceleration, respectively, of a test block in a situation with incipient cavitation.
Figure 10B:
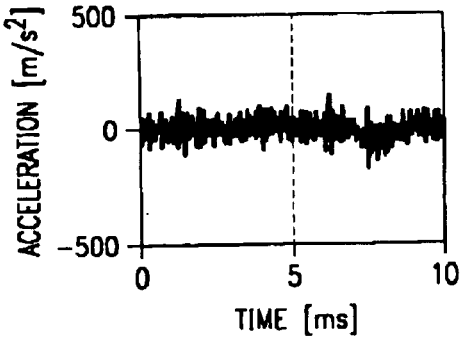
Figure 11A:
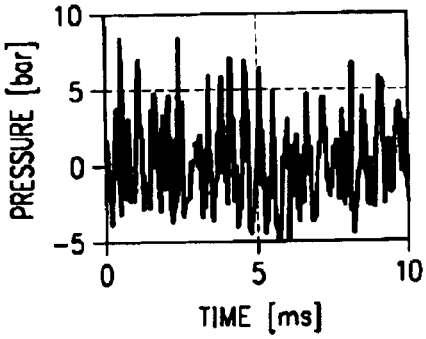
FIGS. 11*a–b* are graphs of downstream chamber pressure and test block acceleration, respectively, of a test block in a situation with developed cavitation.
Figure 11B:
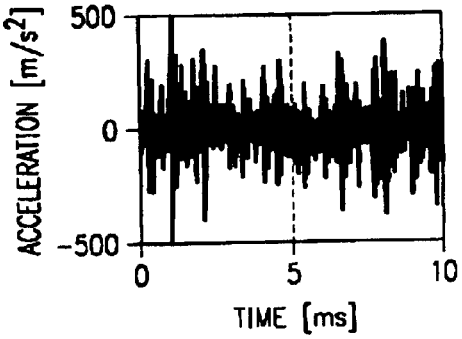

FIGS. 9*a–b* are graphs of downstream chamber pressure and test block acceleration, respectively, of a test block in a situation without cavitation. FIGS. 10*a–b* are graphs of downstream chamber pressure and test block acceleration, respectively, of the test block in a situation with incipient cavitation. FIGS. 11*a–b* are graphs of downstream chamber pressure and test block acceleration, respectively, of the test block in a situation with developed cavitation.

In FIGS. 9*a–b*, 10*a–b*, and 11*a–b*, time is shown in units of milliseconds ("ms"). In FIGS. 9*a*, 10*a*, and 11*a*, pressure is shown in units of barometers ("bar"). In FIGS. 9*b*, 10*b*, and 11*b*, acceleration is shown in units of meters/second$^2$ ("m/s$^2$").

As shown in FIGS. 9*a–b*, 10*a–b*, and 11*a–b*, a fluctuation of downstream chamber pressure and test block acceleration substantially increases as cavitation develops, due to noise components of signals generated by collapse of the cavitation bubbles. Accordingly, some previous techniques have used either a pressure transducer or an accelerometer, at extremely fast data sampling rates, to measure such noise components. Nevertheless, such previous techniques have been susceptible to errors, resulting from other high frequency events (e.g. closure of a pump's discharge valve). Moreover, such previous techniques substantially fail to (a) predictively detect a likelihood of cavitation (e.g. before cavitation extensively develops) and (b) automatically adjust an operation to predictively reduce the likelihood of cavitation.

Figure 12A:
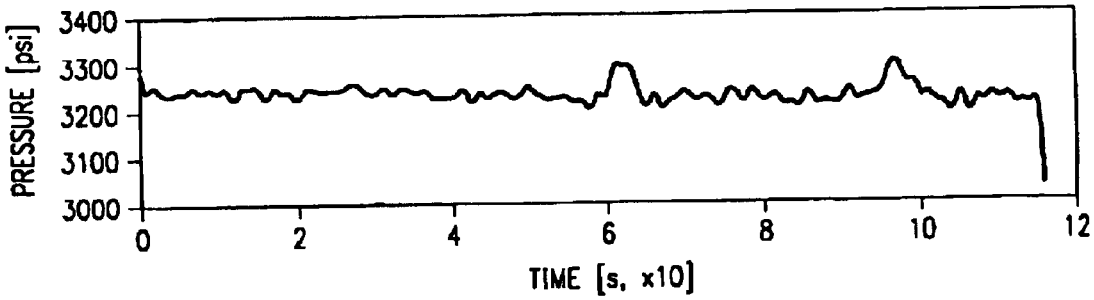
FIGS. 12*a–c* are graphs of discharge pressure, suction pressure, and a $7^{th}$ order wavelet decomposition of the discharge pressure, respectively, of a positive displacement pump as powered by a $7^{th}$ gear of a transmission in an example operation.
Figure 12B:
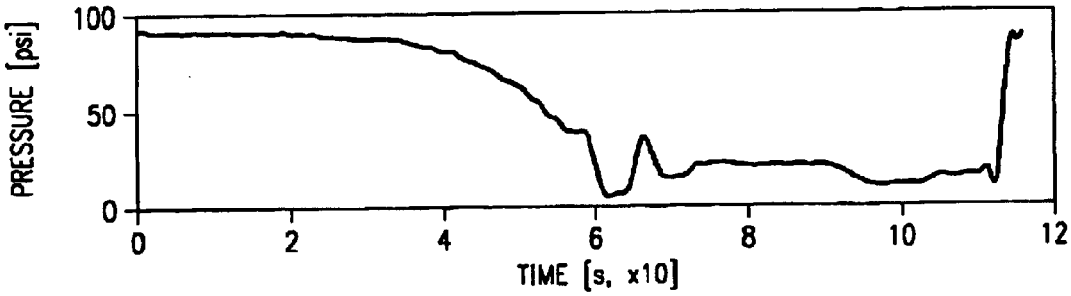
Figure 12C:
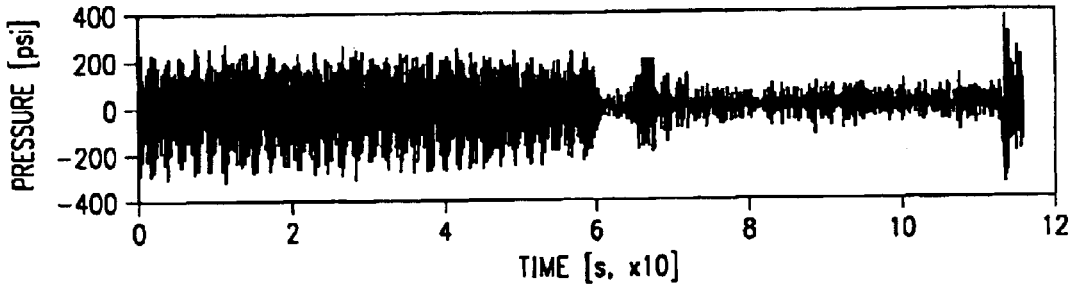

FIGS. 12*a–c* are graphs of discharge pressure, suction pressure, and a 7$^{th}$ order wavelet decomposition of the discharge pressure, respectively, of the positive displacement pump 46 as powered by a 7$^{th}$ gear of the transmission 56 in an example operation.

Figure 13A:
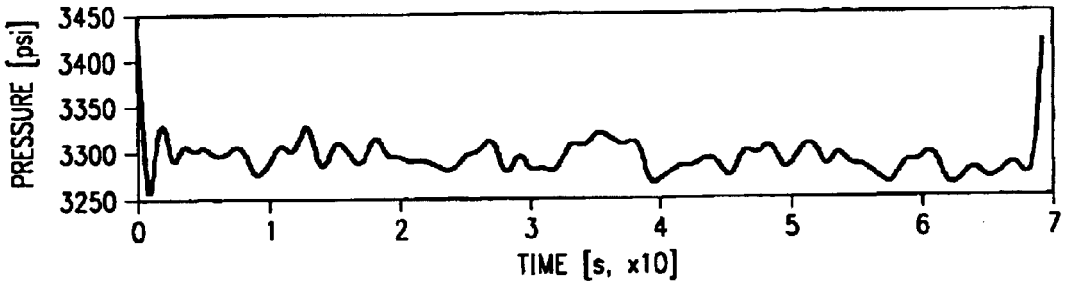
FIGS. 13*a–c* are graphs of discharge pressure, suction pressure, and a $7^{th}$ order wavelet decomposition of the discharge pressure, respectively, of a positive displacement pump as powered by a $6^{th}$ gear of a transmission in an example operation.
Figure 13B:
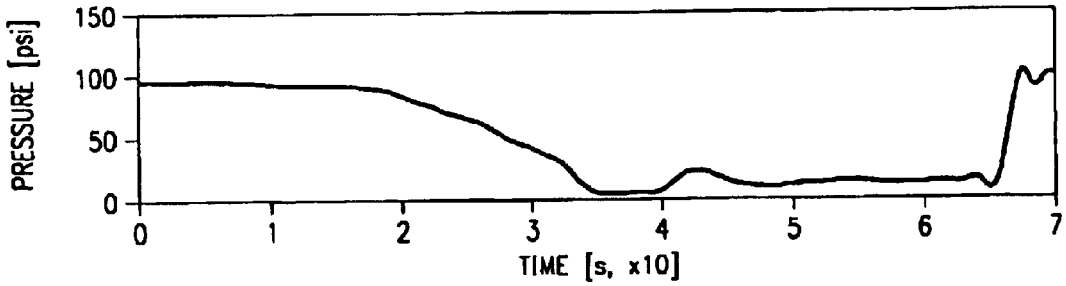
Figure 13C:
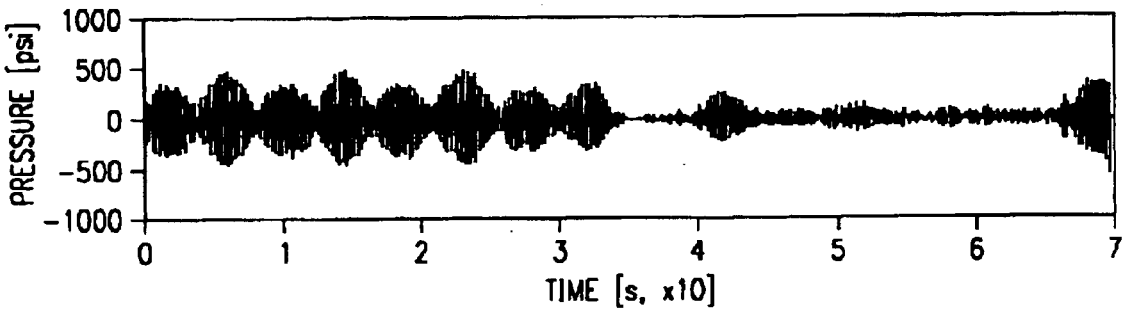

FIGS. 13*a–c* are graphs of discharge pressure, suction pressure, and a 7$^{th}$ order wavelet decomposition of the discharge pressure, respectively, of the positive displacement pump 46 as powered by a 6$^{th}$ gear of the transmission 56 in an example operation.

Figure 14A:
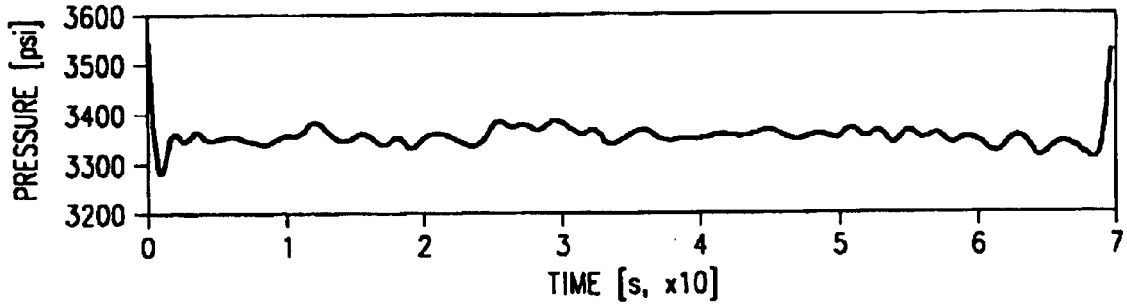
FIGS. 14*a–c* are graphs of discharge pressure, suction pressure, and a $7^{th}$ order wavelet decomposition of the discharge pressure, respectively, of a positive displacement pump as powered by a $5^{th}$ gear of a transmission in an example operation.
Figure 14B:
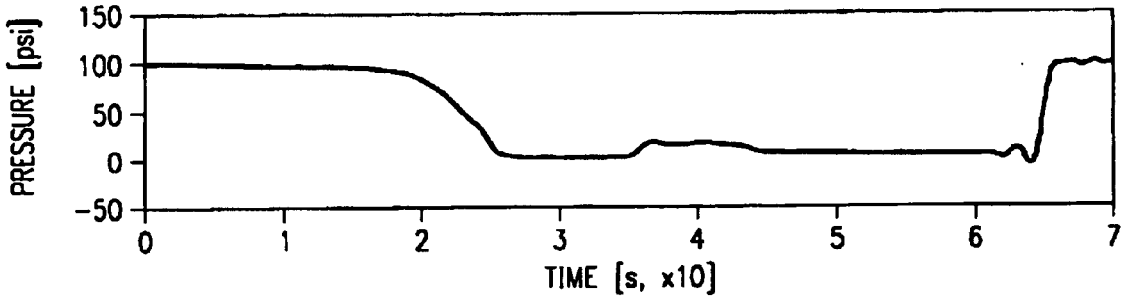
Figure 14C:
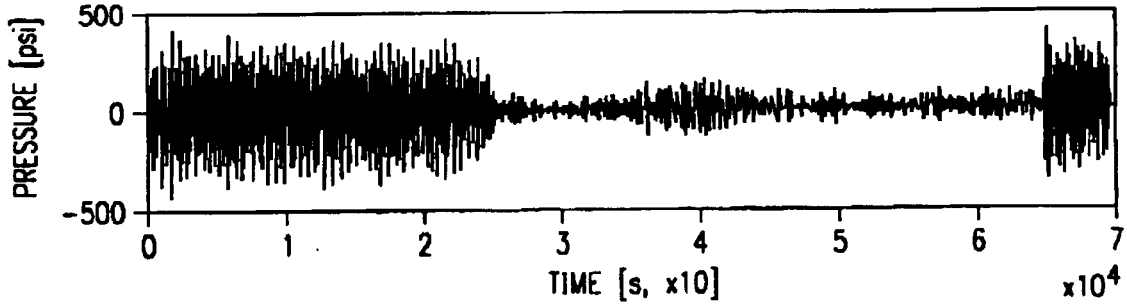

FIGS. 14*a–c* are graphs of discharge pressure, suction pressure, and a 7$^{th}$ order wavelet decomposition of the discharge pressure, respectively, of the positive displacement pump 46 as powered by a 5$^{th}$ gear of the transmission 56 in an example operation.

Figure 15A:
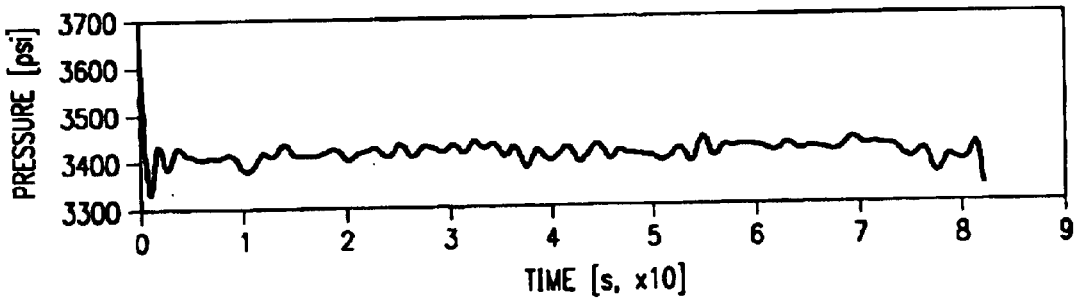
FIGS. 15*a–c* are graphs of discharge pressure, suction pressure, and a $7^{th}$ order wavelet decomposition of the discharge pressure, respectively, of a positive displacement pump as powered by a $4^{th}$ gear of a transmission in an example operation.
Figure 15B:
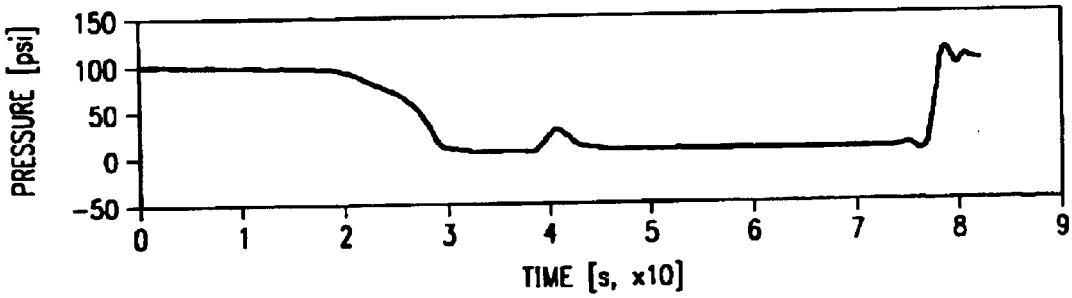
Figure 15C:
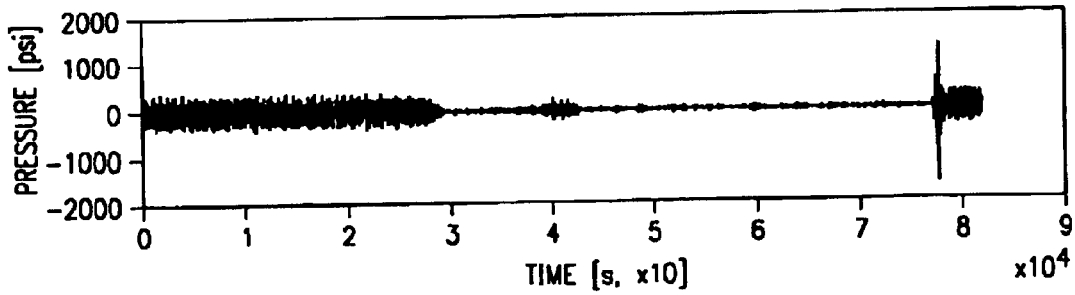

FIGS. 15*a–c* are graphs of discharge pressure, suction pressure, and a 7$^{th}$ order wavelet decomposition of the discharge pressure, respectively, of the positive displacement pump 46 as powered by a 4$^{th}$ gear of the transmission 56 in an example operation.

Figure 16A:
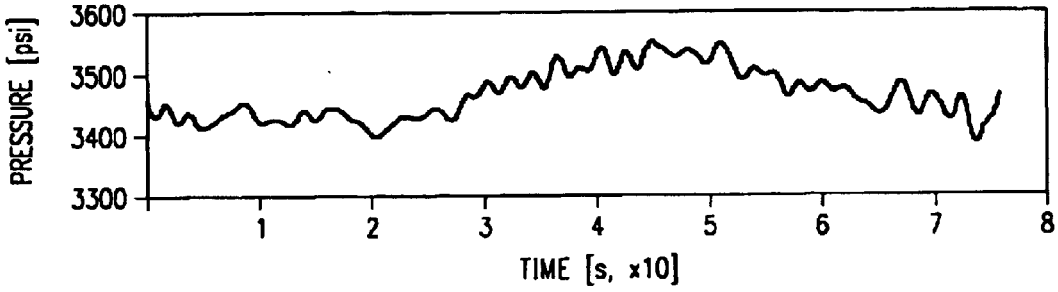
FIGS. 16*a–c* are graphs of discharge pressure, suction pressure, and a $7^{th}$ order wavelet decomposition of the discharge pressure, respectively, of a positive displacement pump as powered by a $3^{rd}$ gear of a transmission in an example operation.
Figure 16B:
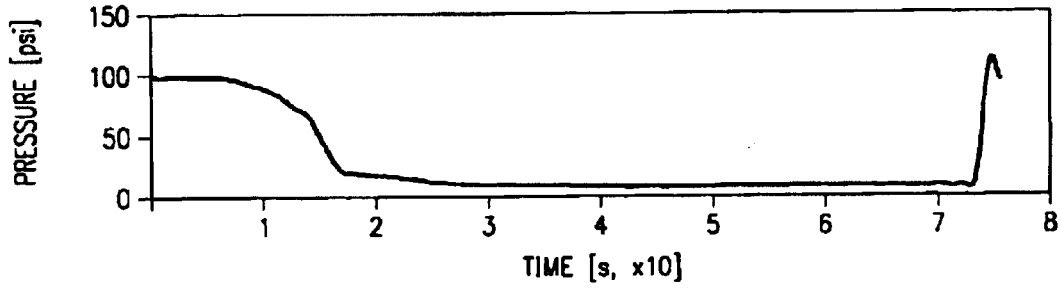
Figure 16C:
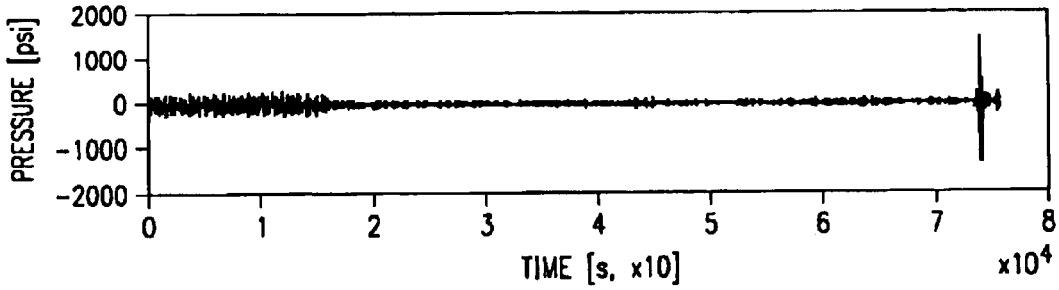

FIGS. 16*a–c* are graphs of discharge pressure, suction pressure, and a 7$^{th}$ order wavelet decomposition of the discharge pressure, respectively, of the positive displacement pump 46 as powered by a 3$^{rd}$ gear of the transmission 56 in an example operation.

Figure 17A:
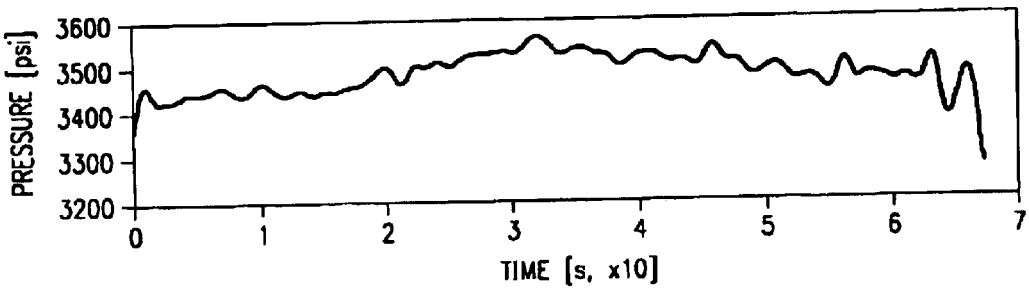
FIGS. 17*a–c* are graphs of discharge pressure, suction pressure, and a $7^{th}$ order wavelet decomposition of the discharge pressure, respectively, of a positive displacement pump as powered by a $2^{nd}$ gear of a transmission in an example operation.
Figure 17B:
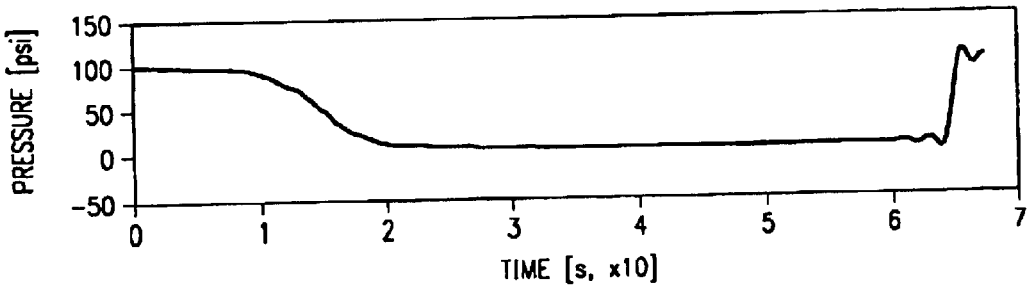
Figure 17C:
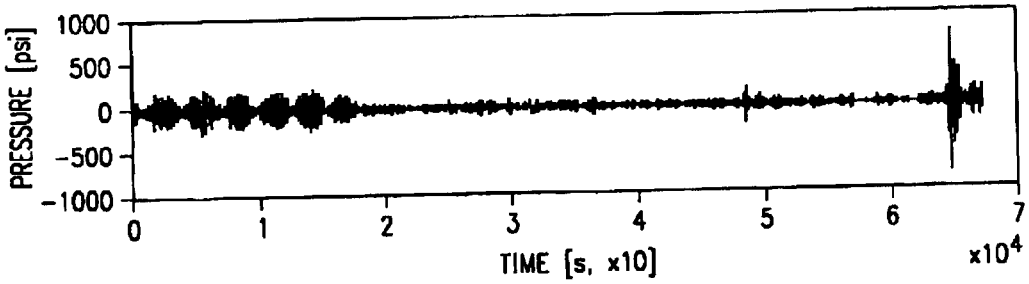

FIGS. 17*a–c* are graphs of discharge pressure, suction pressure, and a 7$^{th}$ order wavelet decomposition of the discharge pressure, respectively, of the positive displacement pump 46 as powered by a 2$^{nd}$ gear of the transmission 56 in an example operation.

In FIGS. 12*a–c*, 13*a–c*, 14*a–c*, 15*a–c*, 16*a–c*, and 17*a–c*, time is shown in units of 10 seconds In FIGS. 12*a*, 13*a*, 14*a*, 15*a*, 16*a*, and 17*a*, discharge pressure is shown in units of pounds per square inch. In FIGS. 12*b*, 13*b*, 14*b*, 15*b*, 16*b*, and 17*b*, suction pressure is shown in units of pounds per square inch. In FIGS. 12*c*, 13*c*, 14*c*, 15*c*, 16*c*, and 17*c*, the 7$^{th}$ order wavelet decomposition of the discharge pressure is shown in units of pounds per square inch of a Db10 wavelet.

As shown in FIGS. 12*b*, 13*b*, 14*b*, 15*b*, 16*b*, and 17*b*, the suction pressure substantially decreases as cavitation develops. Moreover, as shown in FIGS. 12*c*, 13*c*, 14*c*, 15*c*, 16*c*, and 17*c*, near (e.g. shortly after) the beginning of such decrease in the suction pressure, a fluctuation of the 7$^{th}$ order wavelet decomposition substantially decreases. Such diminished fluctuation might result from a damping effect of compressible fluid material within the chamber 108 of the positive displacement pump 46, because such fluid material becomes more compressible as cavitation bubbles are formed.

Accordingly, by decomposing the analog current signal (from the pressure transducer 84) into a Db10 wavelet and analyzing a 7$^{th}$ order wavelet decomposition thereof (to detect a substantial decrease in fluctuation of the 7$^{th}$ order wavelet decomposition), the single board computer 82 predictively detects a likelihood of such cavitation in the positive displacement pump 46. For example, in response to such fluctuation decreasing below a predetermined threshold level, the single board computer 82 predictively detects such likelihood and performs the step 122 of FIG. 6.

Referring again to FIG. 2, each DAC computer is an IBM-compatible computer that executes Microsoft Windows NT operating system ("OS") software, or alternatively is any computer that executes any OS.

Each DAC computer is connected to its respective computing system's input devices and display device. Also, each DAC computer and a human user operate in association with one another. For example, the human user operates the computing system's input devices to input information to the DAC computer, and the DAC computer receives such information from the input devices. Moreover, in response to signals from the DAC computer, the computing system's display device displays visual images, and the human user views such visual images.

The input devices include, for example, a conventional electronic keyboard and a pointing device such as a conventional electronic "mouse," rollerball or light pen. The human user operates the keyboard to input alphanumeric text information to the DAC computer, and the DAC computer receives such alphanumeric text information from the keyboard. The human user operates the pointing device to input cursor-control information to the DAC computer, and the DAC computer receives such cursor-control information from the pointing device.

Each computer of FIG. 2 includes a memory device (e.g. random access memory ("RAM") device and read only memory ("ROM") device) for storing information (e.g. instructions executed by the computer and data operated upon by the computer in response to such instructions). Also, each computer of FIG. 2 includes various electronic circuitry for performing operations of the computer. Moreover, as discussed below, each computer includes (and is structurally and functionally interrelated with) a computer-readable medium, which stores (or encodes, or records, or embodies) functional descriptive material (e.g. including but not limited to computer programs, also referred to as computer applications, and data structures).

Such functional descriptive material imparts functionality when encoded on the computer-readable medium. Also, such functional descriptive material is structurally and functionally interrelated to the computer-readable medium. Within such functional descriptive material (e.g. information), data structures define structural and functional interrelationships between such data structures and the computer-readable medium (and other aspects of the computer's respective computing system and the pump system 42).

Such interrelationships permit the data structures' functionality to be realized. Also, within such functional descriptive material, computer programs define structural and functional interrelationships between such computer programs and the computer-readable medium (and other aspects of the computer's respective computing system and the pump system 42). Such interrelationships permit the computer programs' functionality to be realized.

For example, the computer reads (or accesses, or copies) such functional descriptive material from its computer-readable medium into its memory device, and the computer performs its operations (as discussed elsewhere herein) in response to such material which is stored in the computer's memory device. More particularly, the computer performs the operation of processing a computer application (that is stored, encoded, recorded or embodied on its computer-readable medium) for causing the computer to perform additional operations (as discussed elsewhere herein). Accordingly, such functional descriptive material exhibits a functional interrelationship with the way in which the computer executes its processes and performs its operations.

Further, the computer-readable medium is an apparatus from which the computer application is accessible by the computer, and the computer application is processable by the computer for causing the computer to perform such additional operations. In addition to reading such functional descriptive material from the computer-readable medium, each DAC computer is capable of reading such functional descriptive material from (or through) the LAN 92, which is also a computer-readable medium (or apparatus). Moreover, the memory device of each computer is itself a computer-readable medium (or apparatus).

Although illustrative embodiments have been shown and described, a wide range of modification, change and substitution is contemplated in the foregoing disclosure and, in some instances, some features of the embodiments may be employed without a corresponding use of other features. For example, in an alternative embodiment, without the LAN 92, a human operator (instead of the DAC 70) would manually adjust speed of the centrifugal pump 44 to substantially avoid cavitation, in response to the human operator viewing the indicator 90 (i.e. in response to whether the indicator 90 is illuminated, which indicates whether a cavitation event has occurred). It is also understood that the drawings and their various components shown and discussed above are not necessarily drawn to scale. It is also understood that spatial references are for the purpose of illustration only and do not limit the specific orientation or location of the structure described above.

Although only a few illustrative embodiments of these inventions have been described in detail above, those skilled in the art will readily appreciate that many other modifications are possible in the illustrative embodiments without materially departing from the novel teachings and advantages of these inventions. For example, although techniques of the illustrative embodiments have been described for detecting and substantially avoiding cavitation in a positive displacement pump, such techniques are likewise applicable for detecting and substantially avoiding cavitation in a centrifugal pump. Accordingly, all such modifications are intended to be included within the scope of these inventions as defined in the following claims.

What is claimed is:

1. A method for detecting cavitation in a pump, comprising the steps of:

providing a signal indicative of a condition of the pump;

decomposing the signal into a Daubechies wavelet; and analyzing the Daubechies wavelet to detect cavitation in the pump.

2. The method of claim 1 wherein the step of analyzing comprises the step of analyzing an $n^{th}$ order wavelet decomposition of the Daubechies wavelet.

3. The method of claim 2 wherein the step of analyzing the $n^{th}$ order wavelet decomposition of the Daubechies wavelet comprises the step of analyzing a fluctuation of the $n^{th}$ order wavelet decomposition of the Daubechies wavelet such that cavitation in the pump is detected in response to the fluctuation decreasing below a predetermined threshold level.

4. The method of claim 3 wherein the Daubechies wavelet is a Daubechies 10 wavelet.

5. The method of claim 4 wherein the $n^{th}$ order wavelet decomposition of the Daubechies 10 wavelet is a $7^{th}$ order wavelet decomposition of the Daubechies 10 wavelet.

6. A method for detecting cavitation in a pump, comprising the steps of:

providing a pressure signal indicative of a condition of the pump;

decomposing the pressure signal into a wavelet; and analyzing the wavelet to detect cavitation in the pump.

7. The method of claim 6 wherein the pressure signal is indicative of a pressure of a fluid material received by the pump.

8. The method of claim 6 wherein the pressure signal is indicative of a pressure of a fluid material received by the pump.

9. The method of claim 6 wherein the pump is a positive displacement pump.

10. The method of claim 6 wherein the pump is a centrifugal pump.

11. The method of claim 6 further comprising the step of adjusting an operation of a pump system that includes the pump, in response to detection of cavitation in the pump, such that cavitation in the pump is reduced.

12. The method of claim 11 wherein the step of adjusting the operation of the pump system comprises the step of increasing a pressure of fluid material received by the pump.

13. The method of claim 11 wherein the step of adjusting the operation of the pump system comprises the step of reducing a flow rate of the pump.

14. A system for detecting cavitation in a pump having a fluid input and a fluid output, comprising:

a pressure transducer for providing a signal indicative of a condition of the pump; and a first computer, wherein the signal is decomposed into a wavelet, and the wavelet is analyzed to detect cavitation in the pump.

15. The system of claim 14 wherein the wavelet is a Daubechies wavelet, and the first computer analyzes an $n^{th}$ order wavelet decomposition of the Daubechies wavelet to detect cavitation in the pump.

16. The system of claim 15 wherein the first computer analyzes a fluctuation of the $n^{th}$ order wavelet decomposition of the Daubechies wavelet such that cavitation in the pump is detected in response to the fluctuation decreasing below a predetermined threshold level.

17. The system of claim 14 wherein the pressure transducer is located adjacent the fluid input of the pump.

18. The system of claim 14 wherein the pressure transducer is located adjacent the fluid output of the pump.

19. The system of claim 14 further comprising a second computer for reducing a speed of the pump in response to detection of cavitation in the pump.

20. The system of claim 14 further comprising:

a boost pump for providing fluid material to the fluid input of the pump;

a second computer; and a third computer;

wherein the second computer instructs the third computer to increase a speed of the boost pump in response to detection of cavitation in the pump by the first computer.

21. The system of claim 20 wherein the second computer reduces a speed of the pump in response to detection of cavitation in the pump when the third computer instructs the second computer that the boost pump is operating at a maximum speed.

22. A system for detecting cavitation in a pump comprising:

a pump;

a boost pump for providing fluid material to the pump;

a sensor for providing a signal indicative of a condition of the pump; and a computer;

wherein;

the signal is decomposed into a wavelet;

the wavelet is analyzed to detect cavitation in the pump; and a speed of the boost pump is increased when cavitation is detected.

23. The system of claim 22 wherein a speed of the pump is decreased when cavitation is detected and the boost pump is operating at a maximum speed.

24. A system for detecting cavitation in a pump comprising:

a pump;

a boost pump for providing fluid material to the pump;

a pressure transducer for providing a signal indicative of a condition of the pump; and a computer, wherein the signal is decomposed into a Daubechies wavelet, and the Daubechies wavelet is analyzed to detect cavitation in the pump.

25. A system for detecting cavitation in a pump, comprising:

a flowmeter for providing a signal indicative of a flowrate of the pump; and a computer, wherein the computer calculates a volumetric efficiency of the pump in response to the flowrate and a speed of the pump, and the computer detects cavitation in the pump in response to a decrease in the volumetric efficiency.

* * * * *